United States Patent [19]

Anderson

[11] 4,184,552

[45] Jan. 22, 1980

[54] MANUALLY ACTUATED IMPACT TOOL

[75] Inventor: J. Edward C. Anderson, Moreland Hills, Ohio

[73] Assignee: Marquette Metal Products Company, Cleveland, Ohio

[21] Appl. No.: 934,005

[22] Filed: Aug. 16, 1978

Related U.S. Application Data

[63] Continuation of Ser. No. 797,750, May 17, 1977, abandoned.

[51] Int. Cl.[2] ..... B25D 15/00

[52] U.S. Cl. ..... 173/93.5

[58] Field of Search ..... 173/93, 93.5; 81/52.3, 81/52.35, 57.39

[56] References Cited

U.S. PATENT DOCUMENTS

| | | | |
|---|---|---|---|
| 1,923,122 | 8/1933 | Smith | 173/93 |
| 2,655,825 | 10/1953 | Gendron | 173/93 |
| 2,758,569 | 8/1956 | Peterson | 173/93 |
| 2,954,714 | 10/1960 | Swenson | 173/93.5 |
| 3,108,506 | 10/1963 | Swenson | 173/93.5 |
| 3,184,998 | 5/1965 | Young | 173/93.5 |
| 3,561,543 | 2/1971 | Ulbing | 173/93.5 |

FOREIGN PATENT DOCUMENTS

| | | | |
|---|---|---|---|
| 1168885 | 9/1958 | France | 173/93 |

*Primary Examiner*—Lawrence J. Staab

[57] ABSTRACT

The manually actuated impact tool for rotatively driving a fastener has a spring in a handle for storage of energy, a rotatable tool head and an inertia member surrounding the tool head and connected to the handle via driving connections. A cam associated with the handle is provided to coact with the driving connections to disengage the driving connections when the tool head rotation is resisted by a predetermined force and the handle is rotated relative to the tool head and to allow re-engagement of the driving connections in another operative condition. A push rod is provided to coact with the handle and inertia member to actuate the spring for storage of energy upon resistance of the tool head to rotation and to rotate the inertia member under the force of the stored energy of the spring and effect conversion of the kinetic energy of the inertia member to impact force on the tool head upon re-engagement of the driving connections. The push rod is substantially straight and connected, at one end, to the inertia member at a point radially outwardly of the rotational axis and, at the other end, is connected to the spring via a ball and socket joint.

4 Claims, 3 Drawing Figures

10
H
T
L
L
2
2
3
3
12
14
16
18
20
32
40
48
49
50
52
54
56
58

H
12
14
32
40
50
52

10
H
T
D
R
L-L
15
16
17
20
22
24
26
28
30
32
34
36
38
40
42
44
46
48
49
50
52
54
56
58

MANUALLY ACTUATED IMPACT TOOL

This application is a continuation of Ser. No. 797,750, filed May 17, 1977, now abandoned.

This invention relates to manually actuated impact tools of the type disclosed in the U.S. Patents to Swenson, U.S. Pat. No. 2,954,714, dated Oct. 4, 1960 and U.S. Pat. No. 3,108,506, dated Oct. 29, 1963 for rotatively driving a fastener.

BACKGROUND OF THE INVENTION

In impact tools disclosed in the aforesaid patents, the energy stored in a spring is released to rotate an inertia or mass member which impacts against a tool head to rotate the latter when driving connections between the inertia member and tool head are brought into rotative alignment. A considerable amount of the stored energy in the spring is dissipated in overcoming friction and, therefore, reducing the effective output of the tool. In the tool disclosed in the Swenson U.S. Pat. No. 2,954,714, the frictional losses occur as a result of side loadings on the pivotal connections of the thrust link and crosshead assembly, which interconnects the inertia member and spring. In the tool disclosed in the patent to Swenson, U.S. Pat. No. 3,108,506, the side loadings on the spring and the curved push rod which is disposed within the coils of the spring and interconnects the inertia member and spring, results in frictional losses between the spring and push rod. Also, because of side loadings, frictional losses occur between the spring and a stiffening rod which extends within the spring coils to prevent buckling of the spring as well as between the spring and a guard trough which confines lateral movement of the spring. Therefore, these impact tools, to deliver impact forces of a specified magnitude, have to be made larger to compensate for the frictional losses than would be required if those losses were substantially reduced.

Accordingly, it is an object of the present invention to provide a manually actuated impact tool capable of providing greater impact force than impact tools of like type and of comparable size.

It is another object of this invention to provide a manually actuated impact tool of relatively simple construction, of high efficiency, and improved reliability.

SUMMARY OF THE INVENTION

Accordingly, the present invention contemplates an improved manually actuated impact tool of the type comprising a rotatable tool head for engaging a fastening member and a rotational inertia member surrounding the tool head and capable of rotation relative to the tool head. A driving connection is provided between the inertia member and the tool head. An operating handle is disposed adjacent to and capable of movement relative to the inertia member. The handle is constructed and arranged so that its longitudinal axis extends through the rotational axis of the inertia member. A means is provided for coacting with said driving connections for effecting disengagement of said driving connections, when movement of the tool head is resisted by a predetermined force and the handle moves relative to the inertia member, and for effecting reengagement of said driving connections in another operative condition. A spring means is disposed in the handle. A force transmission means coacts with said handle and inertia member to actuate said spring for the storage of energy upon the relative movement of the handle and inertia member and to transmit such stored energy to the inertia member to rotate the inertia member and thereby effect the application of impact force on the tool head upon re-engagement of the driving connections. The improvement, according to this invention, resides in a force transmission means comprising a substantially straight push rod having one end in engagement with the inertia member and, at the opposite end, coupled through a universal connection of low friction, to the spring means.

In a more narrow scope, the inventive concept comprises one end of the push rod engaging the inertia member at a point on the latter's radius a distance R from its rotational axis and wherein the push rod length D is in the order of about 3 to 5 times that of the distance R.

It has been found that the manually actuated impact tool of this invention, by reduction of friction losses and more direct application of stored spring energy on the inertia member, achieves greater impact forces than is possible with comparable size manually actuated impact tools of the type disclosed in the aforesaid United States patents. In addition, the use of a low friction universal connection rather than a thrust link and crosshead assembly having pivotal connections as shown in the Swenson U.S. Pat. No. 2,954,714 results in the reduction of binding and bearing pressures so that an impact tool of improved reliability is provided. With this reduction of the loadings on the crosshead, such element can be made of material having a low coefficient of friction, thus reducing the lubrication requirements of the heretofore manually actuated impact tools.

BRIEF DESCRIPTIONS OF THE DRAWINGS

The invention will be more fully understood from the following detailed description thereof when considered in connection with the accompanying drawings and in which.

DESCRIPTION OF THE PREFERRED EMBODIMENTS

Figure 1:
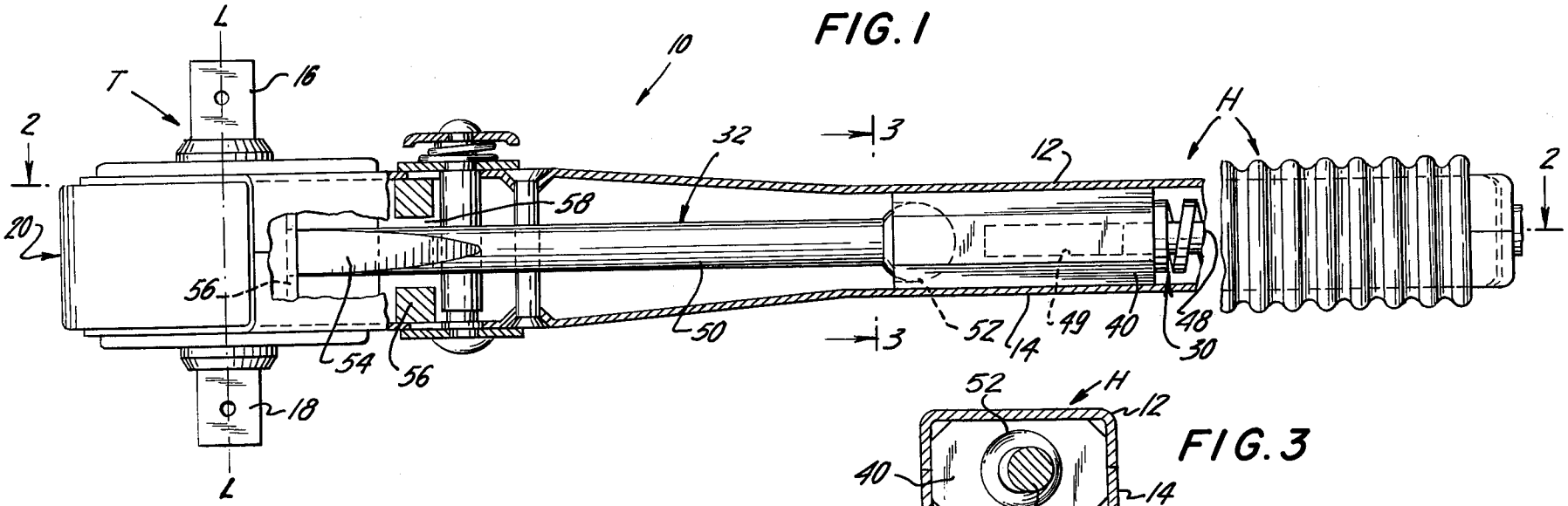
FIG. 1 is a side elevational view of a manual impact tool, according to this invention, in which parts thereof are broken away for illustration purposes.
Figure 3:
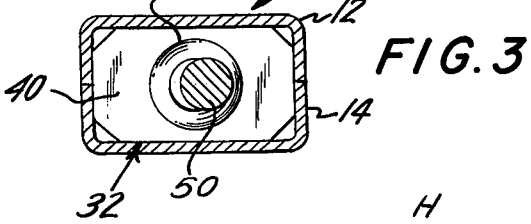
FIG. 3 is a view in cross-section taken along line 3—3 of FIG. 1.

Now referring to the drawings, the reference number 10 generally designates the manually actuated impact tool according to the present invention. The impact tool 10 comprises a handle H formed of complemental unitary, sheet-metal, half shells 12 and 14 on which a tool head T is supported on bearing bushings 15 (only one shown in FIG. 2). The bearing bushings 15 are fixed to each of the half shells 12 and 14 and have peripheral camming surfaces 17.

The tool head T may, as shown, be of the construction disclosed in the U.S. Patents to Swenson, U.S. Pat. No. 2,954,714 and U.S. Pat. No. 3,108,506. As shown, tool head T may comprise socket holders or drive stub portions 16 and 18 which are integral extensions of circular shaft portions (not shown) which turn freely in the bearing bushing 15. Disposed around and freely rotatable on the external peripheral surfaces of bearing bushings is an annular rotor or inertia member 20.

The inertia member 20 is of doughnut shape and closely surrounds a ratchet-toothed portion 22 which also forms part of tool head T. A plurality of circumferentially equi-spaced pawls 24 are disposed in cavities 26 in the inner surface of the inertia member 20. Each of the pawls 24 is carried by and pivotally movable relative to inertia member 20. A spring 28 is disposed in each cavity to bias the associated pawl in a direction to engage a ratchet tooth. The camming surfaces 17 of bushings 15 which move with handle H are operable against pawls 24 and function upon a predetermined angular movement of handle H about the axis L—L of tool head T in a predetermined direction to effect intermittent impacts between the pawls 24 and the ratchet teeth pursuant to a somewhat greater than 30° indexing movement of handle H or upon continuous movement of the handle H with reference to a fastener (not shown) to which the tool head T is coupled.

To provide for accelerating the inertia member and thus provide the desired impact in accordance with the formula $f=(mv^2)/2$ wherein f is force, m is mass and v is velocity, impact tool 10 has a spring assembly 30 disposed in handle H and an improved force transmission means 32, according to this invention.

The spring assembly 30 may comprise a single spring or, alternatively and preferably, two springs 34 and 36 disposed in handle H as shown in the drawings. The use of two springs is preferred because it provides a greater energy storage capacity relative to overall length of the impact tool and provides a handle of a cross-sectional shape for a comfortable grip while at the same time providing a greater energy storage capacity than possible with a single spring in the same size and shape handle. The springs 34 and 36 are disposed between a slidable block 38 and a crosshead or slide 40 which forms part of force transmission means 32. For the adjustment of the force exerted by springs 34 and 36, an adjustment nut 42 is fixed against movement in the end of handle H adjacent slidable block 38 and an adjustment screw 44 is turned into the threaded hole 46 of nut 42 so that its shank extends beyond the hole and into contact with slidable block 38. By rotation of screw 44, slidable block 38 is axially shifted in handle H to thus change the amount of pre-set compression of springs 34 and 36. To guide the springs in their compression and extension and prevent their buckling, a guide rod 48 is disposed within the coils of each spring. Each guide rod 48 is anchored at one end in slidable block 38 and at the opposite end, is slidably receivable in a bore 49 in crosshead 40 so as to be capable of axial movement relative to crosshead 40.

Figure 2:
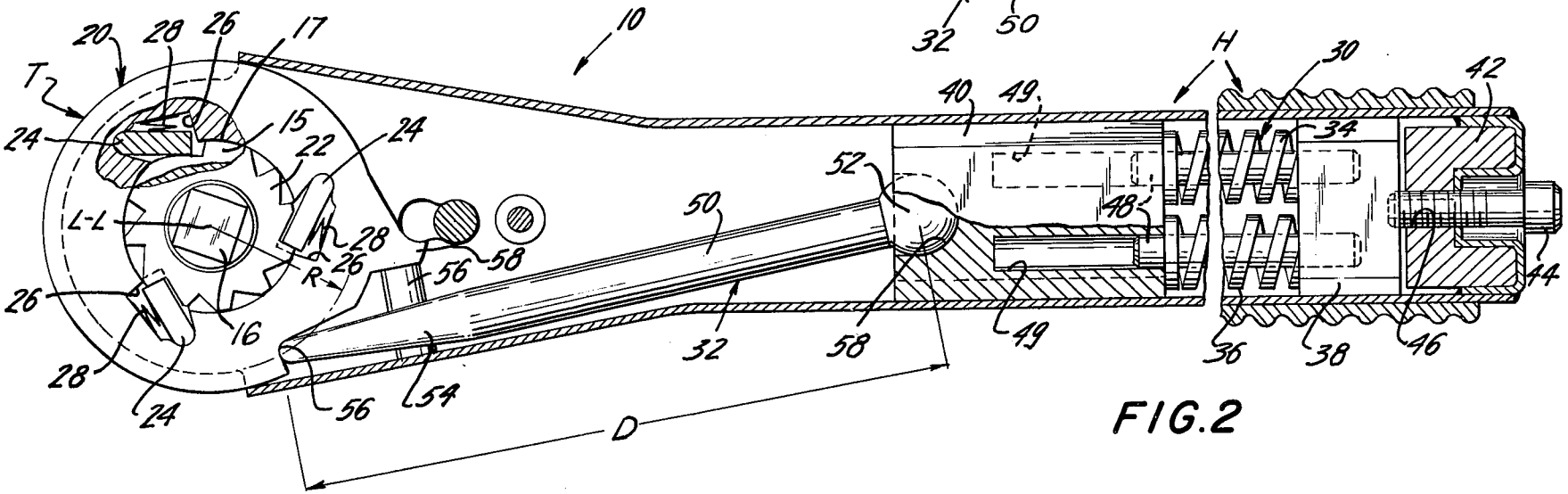
FIG. 2 is a cross-sectional view taken substantially along line 2—2 of FIG. 1.

The force transmission means 32, in addition to crosshead 40, comprises a substantially straight push rod 50 that has a spherical end portion 52 and an opposite tapered end portion 54. The end of tapered end portion 54 engages a notch 56 in the peripheral surface of inertia member 20 at a point a radial distance R from the axis of rotation L—L of tool head T (See FIG. 2). The spherical end portion 52 is seated in a complementarily-shaped socket 58 to provide a universal coupling of low friction. As best shown in FIG. 2 the ratio of the effective length D of push rod 50 is in the order of about 3 to 5 times that of the radial distance R. This relationship of push rod length to radial distance R and the straight configuration of push rod 50 provides the most practical direct application of stored spring energy on the inertia member so that the friction losses due to side loadings are minimized and more of the stored spring energy is translated into rotative force on inertia member 20. The use of a universal coupling of low friction for interconnecting push rod 50 and crosshead 40 also contributes to the minimization of frictional losses.

In the use of manually actuated impact tool 10, the fastener (not shown) to which impact tool 10 is coupled by suitable engaging means, such as a socket (not shown) is turned by turning handle H either continuously in one direction (clockwise as viewed in FIG. 2) or intermittently by oscillating motion causing ratcheting action of pawls 24. When the fastener offers resistance to turning of a magnitude sufficient to overcome the tensional force of springs 34 and 36, the handle H rotatively moves relative to inertia member 20 and ratchet-toothed portion 22. This relative movement forces crosshead 40, via push rod 50, to compress springs 34 and 36, thus loading the springs. Simultaneously, this relative movement rotates bearings 15 and their camming surfaces 17 relative to pawls 24. The movement of the camming surfaces 17 relative to the pawls causes pivotal movement of the pawls out of the path of the ratchet teeth. When the camming surfaces 17 move sufficiently to release pawls 24, the stored spring force drives inertia member 20 so that pawls 24 impact against the next adjacent ratchet teeth, thus rotatively indexing tool head T and the fastener. It is seen, therefore, that the ratchet teeth serve as anvils while pawls 24 function as hammers.

The impact tool 10 is provided with the usual stop blocks 56 on the handle shells 12 and 14 which are engaged by the stop 58 on inertia member 20, if the inertia member 20 and ratchet portion 22, following impact of the pawls, are moved together.

It is believed now readily apparent that a manually actuated impact tool has been disclosed which more efficiently converts the stored spring energy into kinetic energy of the tool head. It is a manually actuated impact tool wherein frictional losses due to side loadings on the force transmission means and springs are substantially reduced to thereby permit the construction of an impact tool of smaller overall size relative to output capacity than heretofore known impact tools of the same type.

Although but one embodiment of the invention has been illustrated and described in detail, it is to be expressly understood that the invention is not limited thereto. Various changes can be made in the arrangement of parts without departure from the scope and spirit of the invention as the same will now be understood by those skilled in the art. For example, spring assembly 30 may be any suitable energy storage means, e.g. an air bag or solid block of resilient material, instead of a spring or springs.

What is claimed is:

1. In a manually operable impact tool comprising a rotatable tool head for engaging a fastening member, a rotational inertia member surrounding said tool head and capable of rotation relative to said tool head, a driving connection between said inertia member and tool head, an operating handle having its longitudinal axis extending through the rotational axis of said inertia member disposed adjacent to and capable of movement relative to said inertia member, means coacting with said driving connections for effecting disengagement of said driving connections when movement of said tool head is resisted by a predetermined force and the handle moves relative to the inertia member and for effecting re-engagement of said driving connections in another operative condition, spring means disposed in said handle, force transmission means coacting with said handle and inertia member to actuate said spring for the storage of energy upon said relative movement of the handle and inertia member and to transmit such stored energy to the inertia member to rotate said inertia member and thereby effect the application of an impact force on said tool head upon re-engagement of said driving connections, said force transmission means includes:

(a) a slide disposed in the handle for linear movement relative to the handle and with one end of the spring means engaging the slide to bias the latter toward said inertia member; and (b) a substantially straight push rod having one end in engagement with the inertia member and at the opposite end coupled by a universal connection of low friction to the slide.

2. The apparatus of claim 1 wherein said universal connection is a ball and socket joint.

3. The apparatus of claim 2 wherein said ball is on the end of said push rod and the socket is in the slide.

4. The apparatus of claim 1 wherein said straight push rod engages the inertia member at a point on latter's radius a distance R from its rotational axis and wherein said push rod has a length D which length is in the order of about 3 to 5 times that of the distance R.

* * * * *